US005103590A

United States Patent [19]

Hanemaayer

[11] Patent Number: 5,103,590

[45] Date of Patent: Apr. 14, 1992

[54] WINDOW OPERATOR FOR USE WITH AWNING ASSEMBLY

[75] Inventor: Jacobus N. Hanemaayer, Kitchener, Canada

[73] Assignee: Hanmar Motor Corporation, Kitchener, Canada

[21] Appl. No.: 542,884

[22] Filed: Jun. 25, 1990

[51] Int. Cl.[5] ..... F05F 11/00

[52] U.S. Cl. ..... 49/324; 49/346

[58] Field of Search ..... 49/324, 339, 341, 342, 49/346, 260, 261, 340, 343, 345

[56] References Cited

U.S. PATENT DOCUMENTS

| | | | |
|---|---|---|---|
| 1,385,574 | 7/1921 | Nordstrom . | |
| 1,456,468 | 5/1923 | Schonfield | 49/343 |
| 1,956,476 | 4/1934 | Rund | 49/324 X |
| 2,528,572 | 11/1950 | Bancroft | 49/324 |
| 2,621,377 | 12/1952 | Meyers | 49/341 |
| 2,662,766 | 12/1953 | Burress | 49/324 |
| 2,811,349 | 10/1957 | Bondurant et al. | 49/324 |
| 2,899,195 | 8/1959 | Ahlgren | 49/324 |
| 3,098,647 | 7/1963 | Teggelaar et al. . | |
| 3,139,276 | 6/1964 | Hay . | |
| 3,258,874 | 7/1966 | Martin . | |
| 3,457,675 | 7/1969 | Armstrong . | |
| 3,461,609 | 8/1969 | Armstrong | 49/324 |
| 4,104,825 | 8/1978 | Hosmer . | |
| 4,143,556 | 3/1979 | Hauber . | |
| 4,617,758 | 10/1986 | Vetter . | |

FOREIGN PATENT DOCUMENTS

| | | | |
|---|---|---|---|
| 595250 | 3/1960 | Canada . | |
| 629974 | 10/1961 | Canada . | |
| 642155 | 6/1962 | Canada . | |
| 687893 | 6/1964 | Canada . | |
| 738877 | 7/1966 | Canada . | |
| 843286 | 6/1970 | Canada . | |
| 85521 | 6/1920 | China . | |
| 1263542 | 3/1968 | Fed. Rep. of Germany | 49/324 |
| 1120641 | 7/1968 | United Kingdom . | |
| 1377529 | 12/1974 | United Kingdom . | |

*Primary Examiner*—Renee S. Luebke
*Assistant Examiner*—Jerry Redman
*Attorney, Agent, or Firm*—Killworth, Gottman, Hagan & Schaeff

[57] ABSTRACT

A window operator for awning windows includes rigid operating arms having balls mounted on the distal ends of the arms. These balls engage in and travel along a guide track which extends along the bottom edge of the awning window. The operator includes a housing which is hinged to a fixed portion of a window frame, the arms being mounted to the housing and a mechanism being provided to effect pivotal motion of the arms thereby to open or close the awning window.

7 Claims, 7 Drawing Sheets

WINDOW OPERATOR FOR USE WITH AWNING ASSEMBLY

BACKGROUND OF THE INVENTION

This invention relates to window operators and in particular to window operators for use in awning-type windows, particularly those of metal construction such as might be used in recreational vehicles, mobile homes and the like. The invention may also be used for casement type windows as well.

The prior art has provided numerous forms of closure operators for awning windows and the like. One such prior art arrangement has a twin arm operator located in a fixed position in the center of the fixed frame at the bottom of the awning. Since the operator is fixed, the arms are not able to move upwardly or downwardly to accommodate the arcuate path of travel of the awning window as it moves between the open and closed positions; such fixed arms can only move outwardly in a generally horizontal plane. In order to accommodate the arcuate movement of the awning window, the rigid twin arms have riveted to them flexible steel extensions with a small wheel on each end which runs in a track which is fastened to the bottom frame of the awning. A problem with these flex steel extensions on the twin arms is that the amount of flexing is relatively limited and this only allows the awning to open to a maximum of about 20° which has the effect of blocking the direct breeze from entering. Since the flexing movement of the steel extensions is limited, awning windows of substantial vertical dimension must be used in order to achieve a relatively shallow or flat arc of movement of the lower edge of the awning. Unfortunately, this arrangement does not permit the awning to be lifted up sufficiently to let direct breezes enter through the window. It would therefore be most desirable to provide a system enabling even relatively short awning windows to be lifted high, i.e. to open up to a very large angle to let the breezes in thereby to provide maximum ventilation. In summary, the twin arm operating arrangement previously known with the flex steel extensions can only be used with awning windows of a substantial height (vertical dimension) and yet at the same time the ventilating capability of such windows is very limited since the low degree of opening angle prevents direct breezes from entering.

Another form of window closure, which also has an operator with a handle for opening and closing located in the center at the bottom of the window frame, includes twin operating arms with linkage extensions of about equal length which pivot at a riveted joint and close in a scissor-like fashion during awning closure while straightening out while the awning is being opened. The linkage extensions are fastened to a pivot point which, in turn is secured centrally at the bottom of the awning frame. One notable drawback of this arrangement is that virtually all mechanical advantage is lost when the awning reaches the closed position. This is due to the fact that when the main arms are in the closed position the linkage extensions are almost parallel to the main arms. Hence, the closing force necessary as to achieve a good seal is difficult, if not impossible, to achieve. Furthermore, there may be a security problem since an intruder may find it relatively easy to pry open the window from the outside with breakage or bending of the linkage mechanisms occurring as a result of the very high stresses involved.

Another window operator previously known incorporates a tubular member running across the bottom of the awning and which is fastened to it on both ends. Eyelets riveted (so that they can pivot) to the ends of the twin arms of the operator slide along the round tube, inwardly toward each other for opening and outwardly away from one another during closure of the awning. Again, the operator is fixed. The flexing of the twin arms is very limited, as they have no flex steel extensions, thereby putting great stress on the operator even when only partially extended. Consequently, this operator can only be used with a high awning window and even then it provides for only a limited ventilation effect, due to the low arc of the awning, thereby preventing the direct breeze from entering.

Various prior art systems have disadvantages in that they are clearly visible either from the outside or the inside; certain of them interfere with screens and/or curtains. Certain systems, owing to play in the linkages caused by manufacturing and installation tolerances, make it practically impossible to synchronize both sides of the sets of linkage pieces with one another thus making it impossible to equalize the pressure or force supplied to both sides of the awning window thereby to effect a good tight closure. Other systems have the operating knob or crank in a position such that the window curtain must be moved every time one needs to turn the knob or crank for opening or closing of the awning.

SUMMARY OF THE INVENTION

It is a general object of the present invention to alleviate the difficulties inherent in the prior art arrangements.

Accordingly, the invention in one aspect provides a window operator for a pivotally mounted window cooperable with a fixed window frame, the window operator comprising an operating mechanism mountable to said fixed window frame, an elongated guide track adapted to extend along a marginal portion of the pivotally mounted window, and wherein the operating mechanism includes rigid elongated arm means and means for effecting pivotal motion of said arm means, the arm means having motion transmitting means mounted to distal free end portions thereof, said motion transmitting means adapted to engage with said elongated guide track and to move therealong as the arm means are pivoted thereby to pivot the window between open and closed positions.

In a further aspect of the invention said arm means comprises a pair of free-ended rigid arms adapted to pivot towards and away from one another in a first plane of movement to pivot the window between open and closed positions respectively, said motion transmitting means comprising a ball secured to the distal end of each of said arms, and said guide track being shaped to secure the balls therein while permitting free movement of the balls therealong.

In a further aspect of the invention the operating mechanism includes hinge means for mounting said operating mechanism to the fixed window frame to allow said arm means and the first plane of movement to pivot about an axis defined by said hinge means during movement of the window between the open and closed positions.

In a preferred form of the invention said ball is secured directly to the distal end of each arm and said guide track including an entrance slot sufficiently wide as to permit a predetermined amount of angular motion of the arm relative thereto and hence of the window between the open and the closed positions.

In a typical embodiment of the invention the operating mechanism includes a housing, proximal end portions of said arm means being pivotally mounted in said housing, gear means for effecting simultaneous pivotal motion of the arm means and manually operable means coupled to said gear means to activate the latter and effect the motion of the arm means.

In a further aspect of the invention there is provided a window operator as described above in combination with an awning window pivotally mounted adjacent its upper extremity. The above-noted guide track extends lengthwise of that portion of the movable frame which is at the lower extremity of the window. The operating mechanism is secured to a lower portion of the fixed window frame in a generally central location therealong.

The window assembly typically includes a fixed upper window with a horizontal intermediate frame member at the bottom edge of the upper window. Hinge means cooperating with the intermediate frame member and secured or combined with an upper edge of the awning window provides the pivoting motion of the awning window between the open and closed positions.

As a further feature of the invention, the elongated guide track is integrally formed with the lower portion of the movable awning frame.

The embodiment of the invention to be described hereinafter possesses numerous advantages over the prior art. The ball and track system coupled with the hinge or pivot mounting of the operator allows changes of arm angle in two planes thus providing an extremely simple yet effective arrangement. The track means, which is preferably integrally formed with the awning frame, is located out of view and since the operating mechanism is typically located in the center at the bottom of the window frame below any window curtain, unobstructed access to the operating knob or crank is provided at all times. The twin arm operating system distributes pressure equally to both sides of the awning window to provide a tight leak-proof closure owing to the fact that both arms and their associated ball members move horizontally towards the lower corners of the awning window and disappear from view when completely closed. Also part of the operator housing enters the track at a notch in the central area of the track.

Other significant advantages include the fact that the operating system allows even a very short awning window to be opened up to a very substantial angle (such as an angle of about 60° when fully opened) thus allowing direct breezes to enter. The awning can be removed from its hinge means when opened 90°. However, a set screw in the central area of the track must be removed first so that the balls on the twin arms can be removed from the track through the notch provided in the central area. Furthermore, in contrast to the prior art relatively high awning windows requiring screens covering the complete window, applicants' arrangement permits the use of a fixed picture window above a relatively short awning window. The screening need only cover the awning section of the window and since the picture window above it has a fixed glass and therefore does not require a screen, it is much more pleasant to look through than a large single pane awning window completely covered by a screen.

In the case of mobile homes and recreational vehicles, in order to provide an attractive appearance and to provide a higher quality window, the window corners are rounded. Another disadvantage of a tall single pane awning is that the rounded corners at the top tend to let rain in when the window is open for venting. The present system is particularly suitable for dual pane windows, the upper pane comprising a fixed glass without a screen for an unobstructed view while the lower pane, comprising the awning window, has the curved corners at the bottom and square corners at the top which meet the lower square corners of the fixed window above thus making it easy to keep the rain out when open.

Numerous other features and advantages of the invention will be readily apparent from the drawings and description which follow.

BRIEF DESCRIPTION OF VIEW OF DRAWINGS

In the drawings which illustrate a preferred embodiment of the invention:

FIG. is a perspective view of an awning window assembly as seen looking toward its interior surfaces;

DETAILED DESCRIPTION OF THE PREFERRED EMBODIMENT

Figure 1:
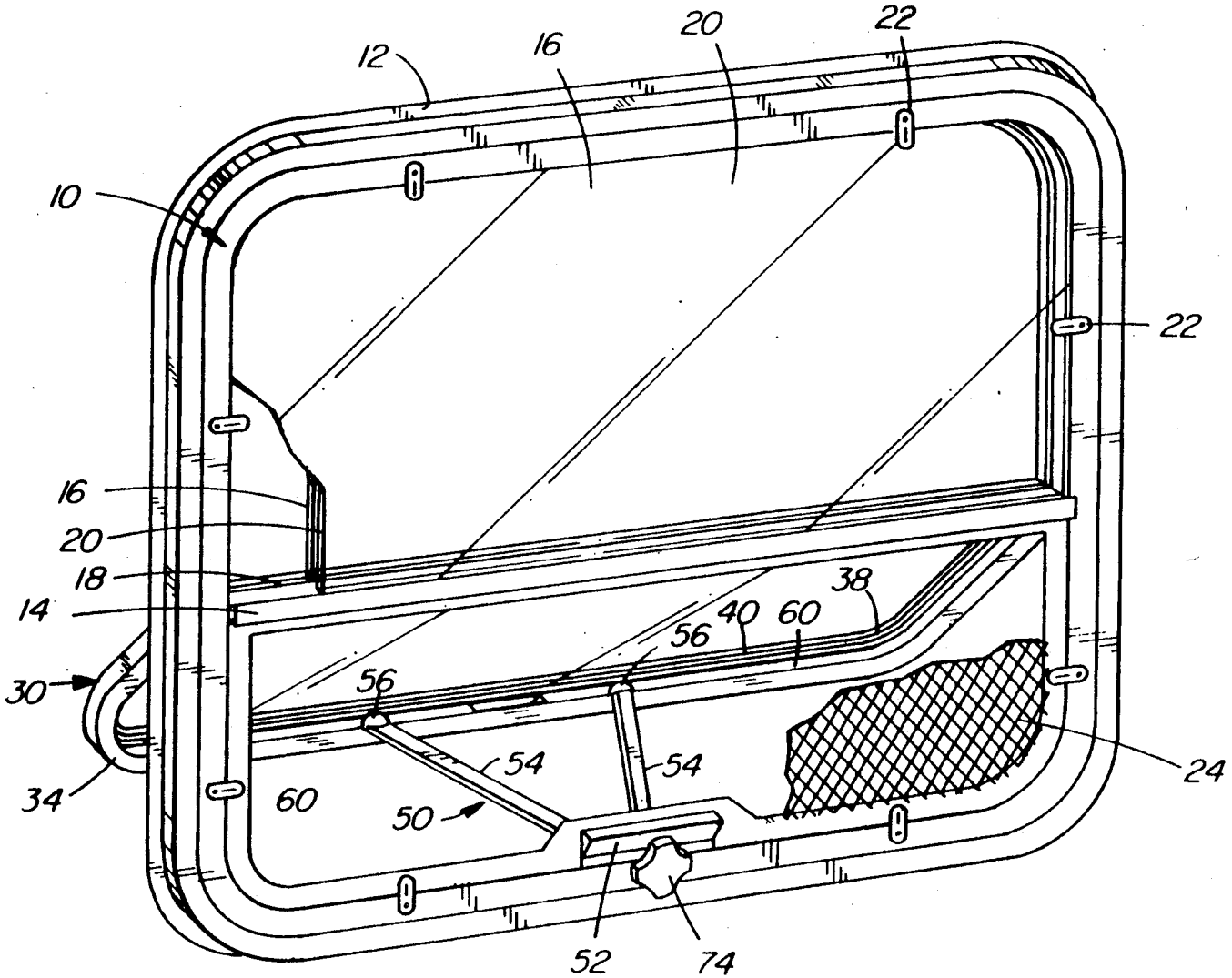
Figure 2:
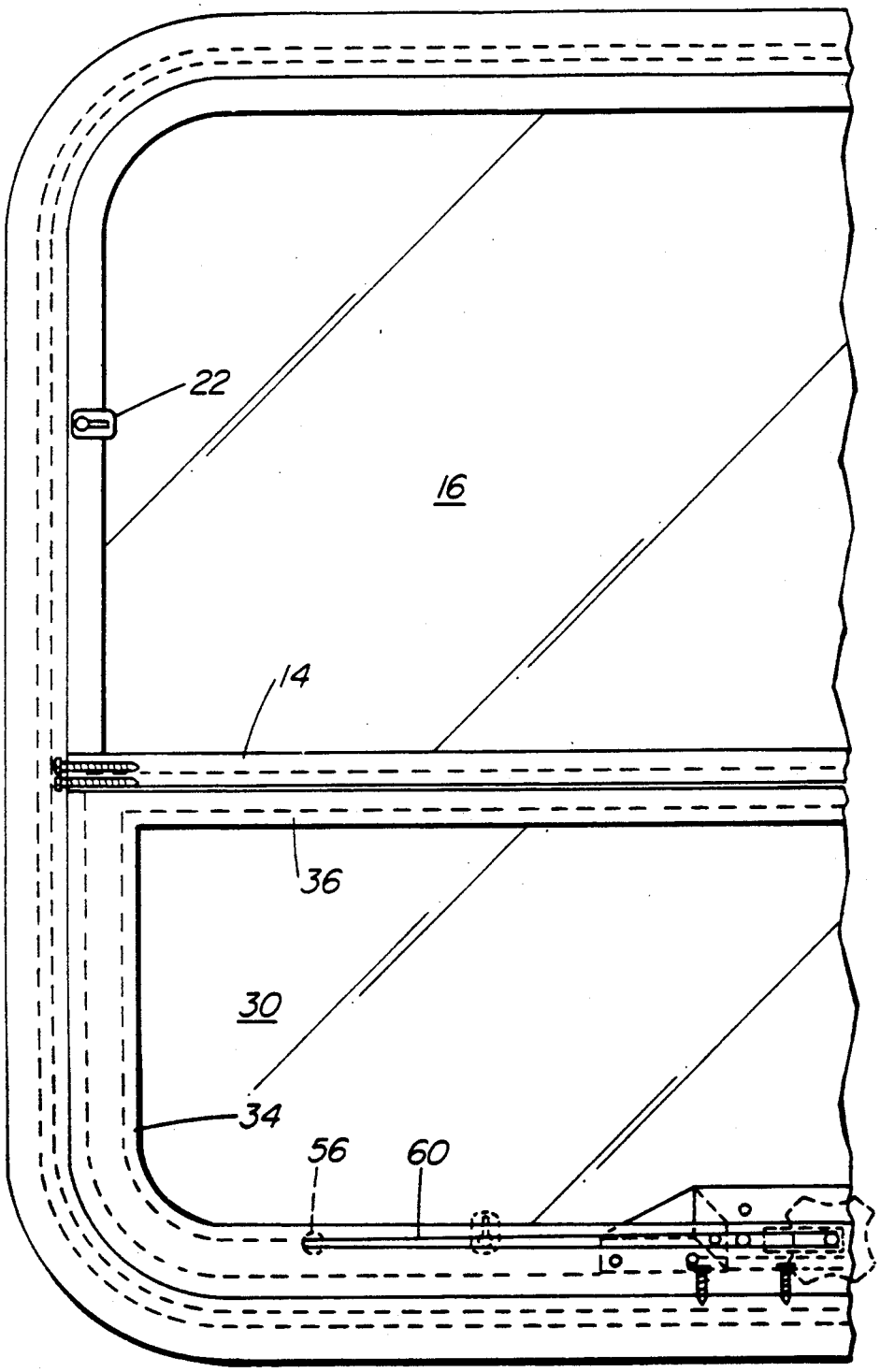
FIG. 2 is a front elevation view looking toward the exterior of a portion of the awning window assembly.

Referring now to the drawings there is shown an awning window assembly which includes a fixed window frame 10 typically made from a metal such as aluminum. As seen in FIG. 1, the fixed frame 10 is provided with an exterior flange 12 which butts up against the exterior wall of, for example, a mobile home or recreational vehicle in which the awning window assembly is installed. Fixed frame 10 includes a horizontal frame member 14 extending completely across the fixed frame 10 and above which frame member 14 is mounted, in the upper half of the fixed window frame, a fixed glass panel 16. The fixed glass panel 16 is mounted around its edges in a suitable rubber mounting strip 18 which in turn is located and secured within a recess defined in the fixed frame 10. These particular mounting means as such are well known in the art and need not be described in detail. A second pane of glass or Plexi-glass 20 may also be provided and, as shown in the drawings, this second pane 20 is removably secured in position over the fixed pane by means of a multiplicity of turn latches 22 all of which are well known per se in the art. A screen 24 is also shown and this may be replaced by a second pane in the winter time.

An awning window 30 is located in the bottom half of the window assembly and is pivotally attached to the horizontal frame member 14 by means of a hinge 32. The awning window 30 is circumscribed by an awning frame 34, the lower corners of the awning frame 34 being smoothly contoured to match the contoured corners of the fixed frame, while the upper corners of same are square so as to match the square lower corners of the fixed glass panel 16 and the horizontal frame member 14. The awning frame 34 includes an upper frame member 36. The glass panel 30 of the awning window is mounted in the awning frame 34 by means of a suitable elongated recess 38 provided by the awning frame 34, within which recess 38 there is disposed an elongated rubber mounting strip 40 all of which are well known per se in the art.

The fixed frame 10 is provided with elongated rubber seal means 42 which make contact with interior surfaces of the awning window 30 all around the perimeter thereof when in the closed position thereby to guard against the entry of rain water and the like.

It will be seen from the drawings that the hinge 32 which pivotally connects the awning window to the fixed horizontal frame member 14 comprises an elongated hook-like hinge element 46 integrally formed with the upper awning frame member 36, which hook-like member 46 is disposed within a complementary groove 48 having a re-entrant portion to secure the hook-like member 46 in place, the elongated groove 48 being formed in the horizontal fixed frame member 14.

In order to move the awning window 30 between the fully open and fully closed positions there is provided a window operator 50 including an operating mechanism 52 mounted to a lower portion of the fixed window frame 10 adjacent a central portion thereof. This operating mechanism includes a pair of rigid free ended arms 54 adapted to pivot toward and away from one another in a first plane of movement to effect pivoting of the awning window 30 between open and closed positions respectively. A ball 56 is secured directly to the distal end of each of the rigid arms 54 in any suitable manner. Since each of the arms 54 is in the form of a relatively narrow elongated flat plate, the thickness of which is chosen to provide the required degree of rigidity, each ball 56 is provided with a slot, the center of which intersects the true center of the ball and which slot snugly receives the free distal end of the respective arm 54. A connection between the ball 56 and arm 54 is made in any suitable manner as by welding or brazing or by casting integrally with the arm all at the same time. The latter procedure does not require a slot in the ball 56.

Figure 5:
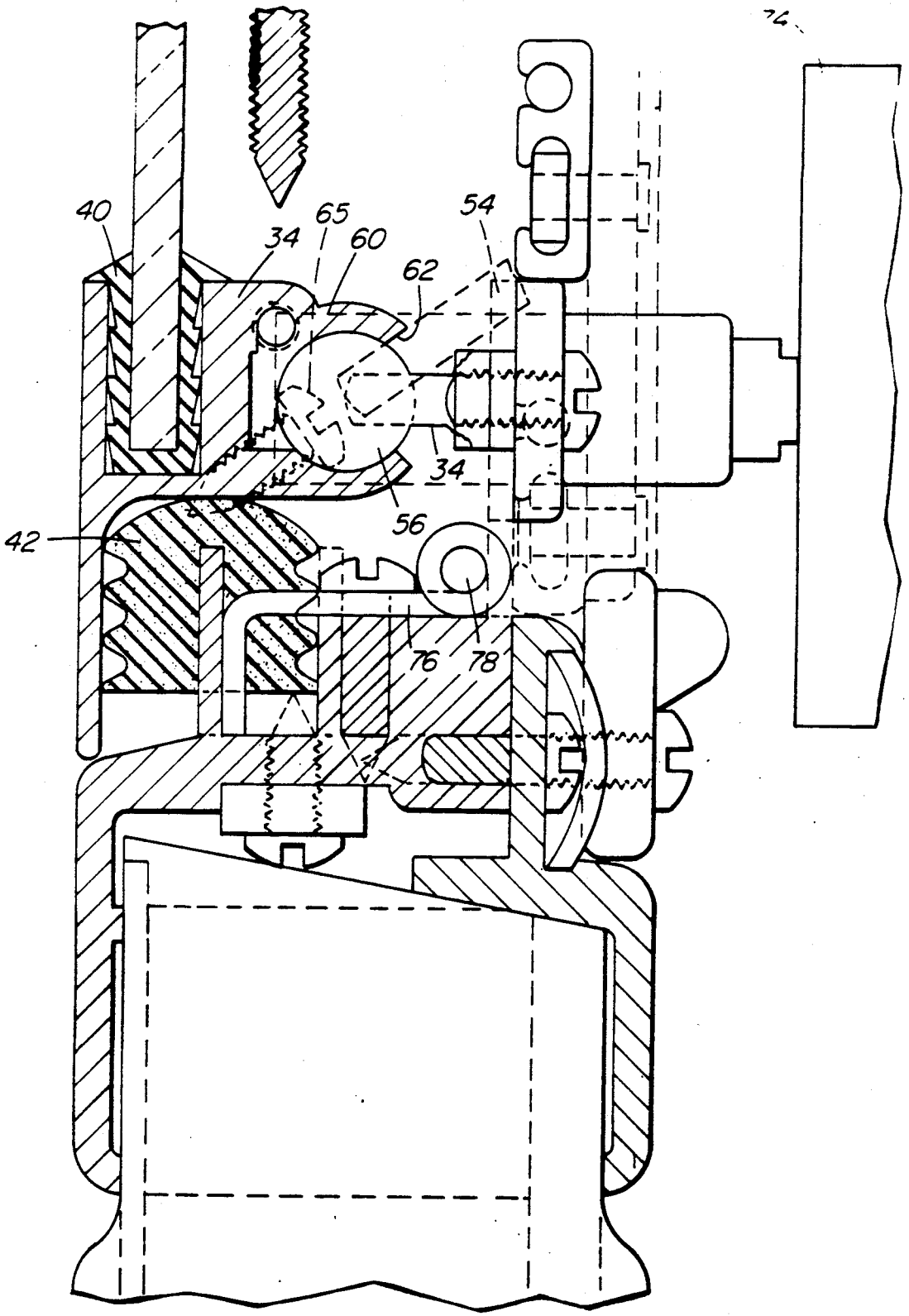
FIG. 5 is a vertical cross-section on an enlarged scale taken through the bottom portion of the awning window.
Figure 6:
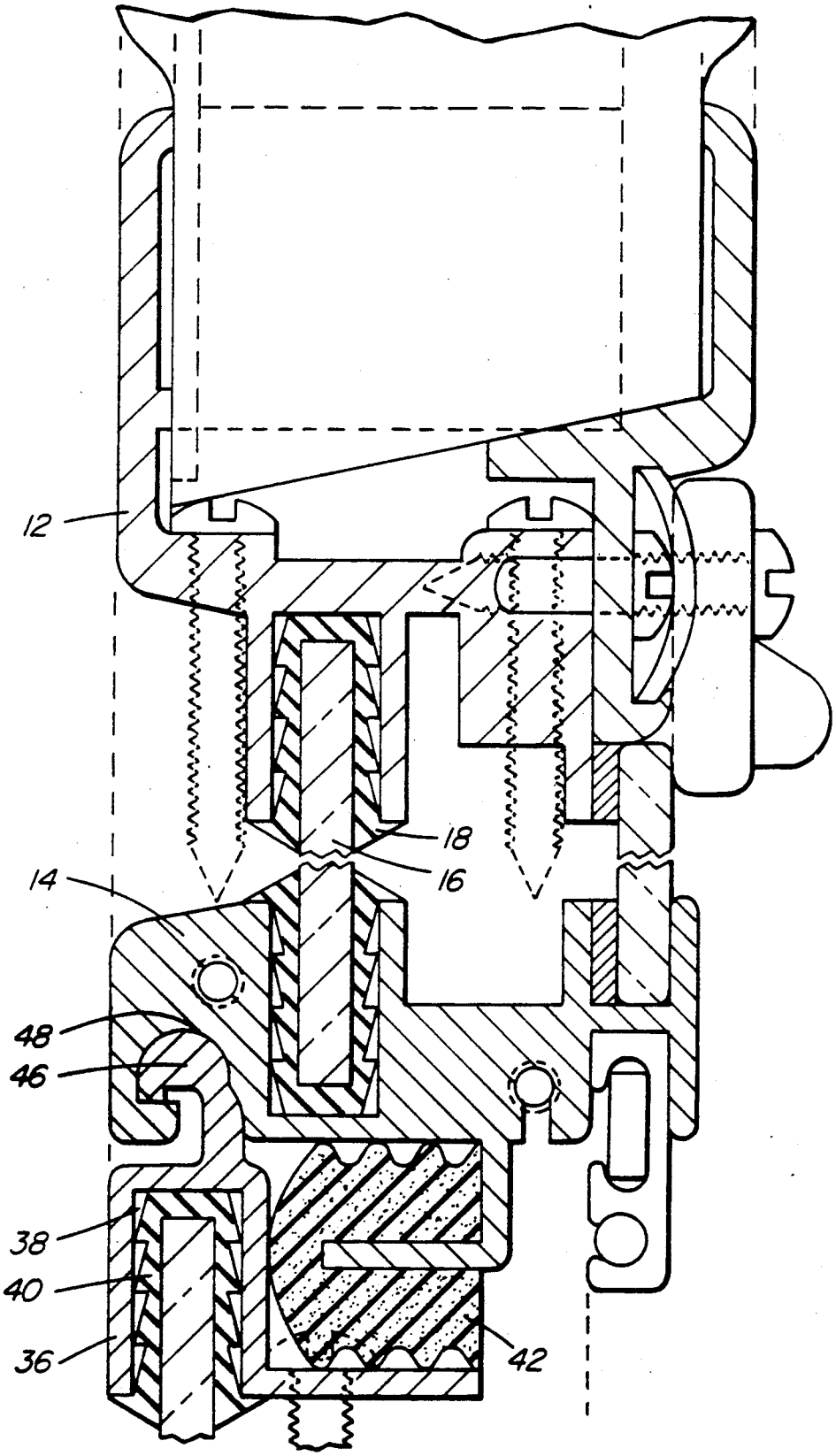
FIG. 6 is a view similar to that of FIG. 5 but taken through the upper portion of the awning window.
Figure 7:
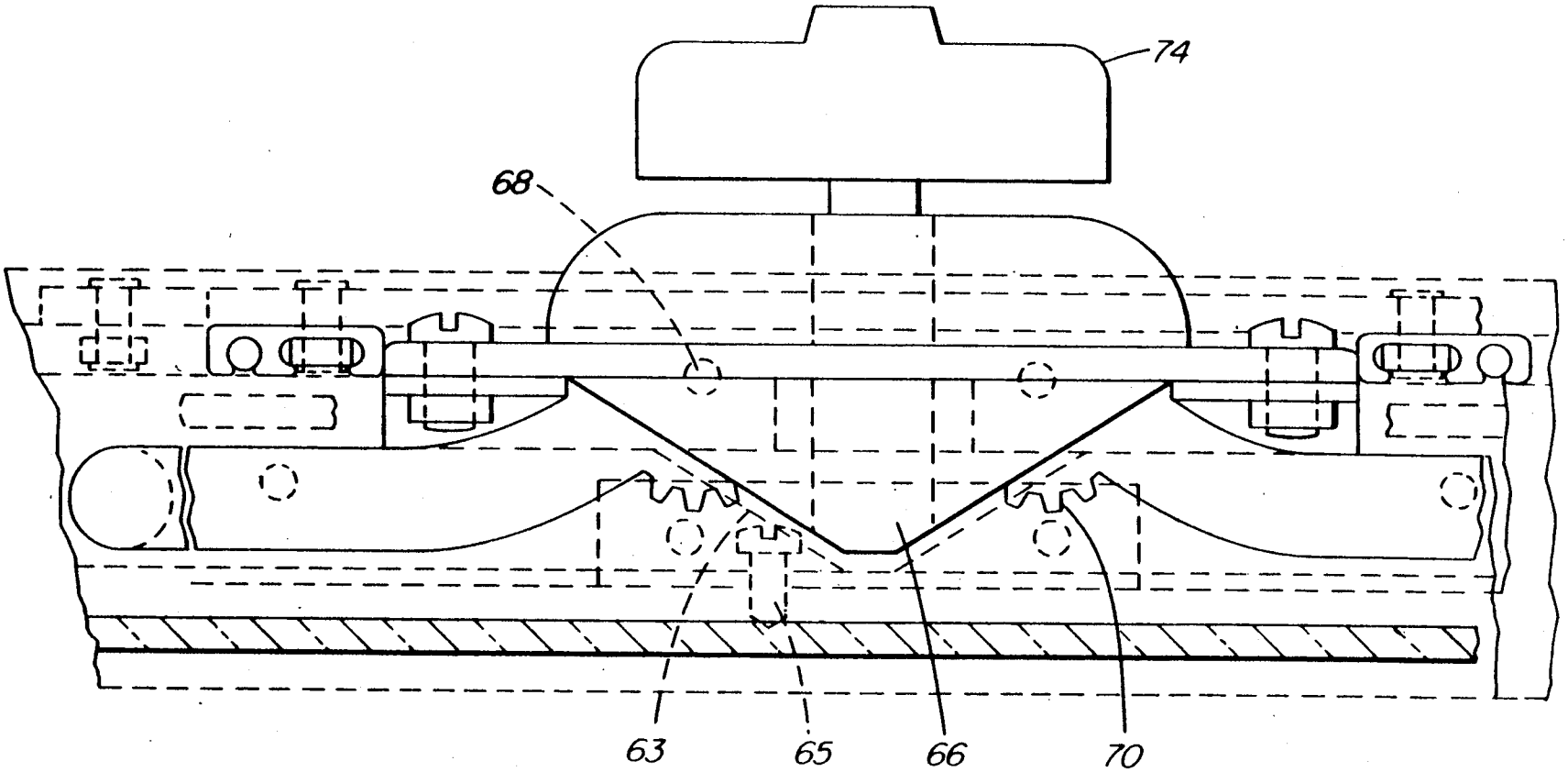
FIG. 7 is a further view showing a notch-out in the guide track and the adjoining structures.

An elongated guide track 60 is integrally formed with the lowermost horizontal portion of the awning frame 34. Details of the guide track are most clearly seen in FIG. 5. This guide track is sufficiently long as to accommodate the full movement of the balls 56 as they are moved by their respective operator arms 54 between the fully open and the fully closed positions. It will also readily be seen from FIG. 5 that the interior surfaces of the guide track 60 are shaped or contoured to define cylindrical segments thereby to accommodate the balls 56 without permitting excessive free play to and fro of the balls while at the same time being smoothly surfaced as to avoid excessive friction and possible jamming of the balls during their longitudinal movement within the guide track 60. It will also clearly be seen that the guide track 60 includes an entrance slot 62 which is sufficiently wide as to permit a substantial amount of angular motion of the arms 54 relative thereto and hence a predetermined degree of angular movement of the awning window between the open and closed positions. The guide track also has a shallow V-shaped notch-out 63 (see FIG. 7) in the central area to allow the balls to enter the track or to exit (for removal of the awning) by first removing the set screw 65 in the central area of the track. The set screw 65 also prevents the balls 56 from escaping the guide track when the awning window 30 is fully open with the arms fully extended and the balls 56 located near the center of the guide tracks. The V-shaped notch 63 also receives the forward portion of the operator housing 66 (which is described hereafter) when the awning window 30 is in the closed position thus preventing interference between them.

Figure 4:
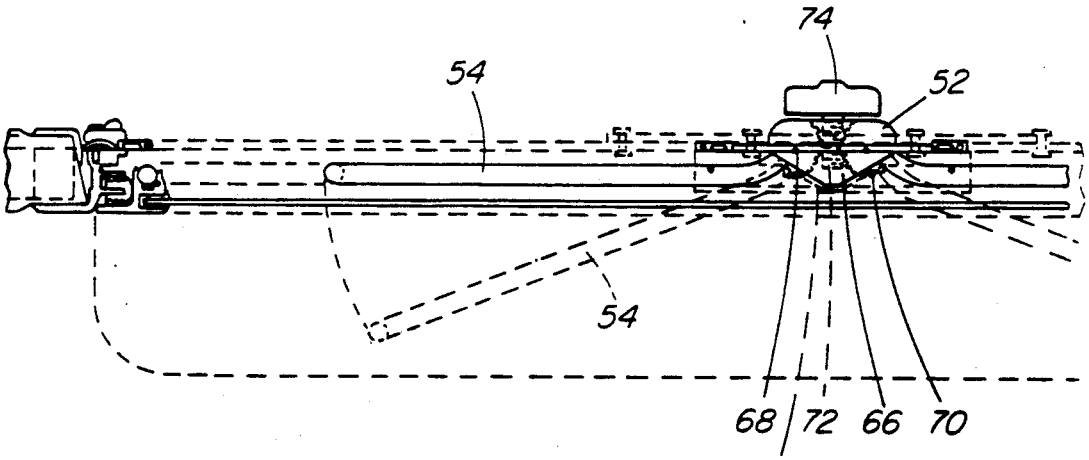
FIG. 4 is a horizontal cross-section view taken through the awning window assembly.

Turning now to the operating mechanism 52 it will be seen that it is of a generally conventional design and includes a housing 66 with proximal end portions of the arms 54 being pivotally mounted in this housing for movement by pivot axles 68. Each arm 54 has a gear sector 70 formed on the proximal end portion of same, which gear sectors 70 engage with a worm gear 72 (shown in dashed lines in FIG. 4) with the worm gear 72 being rotated in turn by an exterior operating knob 74.

Since the lower portion of the awning window 30 moves in an arcuate path between the open and closed positions, it will be readily apparent that the rigid arms 54 must also be capable of pivotal movement in a vertical plane to accommodate this motion (as well as in the first plane of movement at right angles thereto) and in order to permit the former type of motion, the housing 66 of the operating mechanism is mounted to the fixed window frame by means of a hinge 76 including a hinge pin 78 defining a horizontal pivot axis. During opening and closing the window operator rotates between the closed full line position and the open dashed line position illustrated in FIG. 3.

Figure 3:
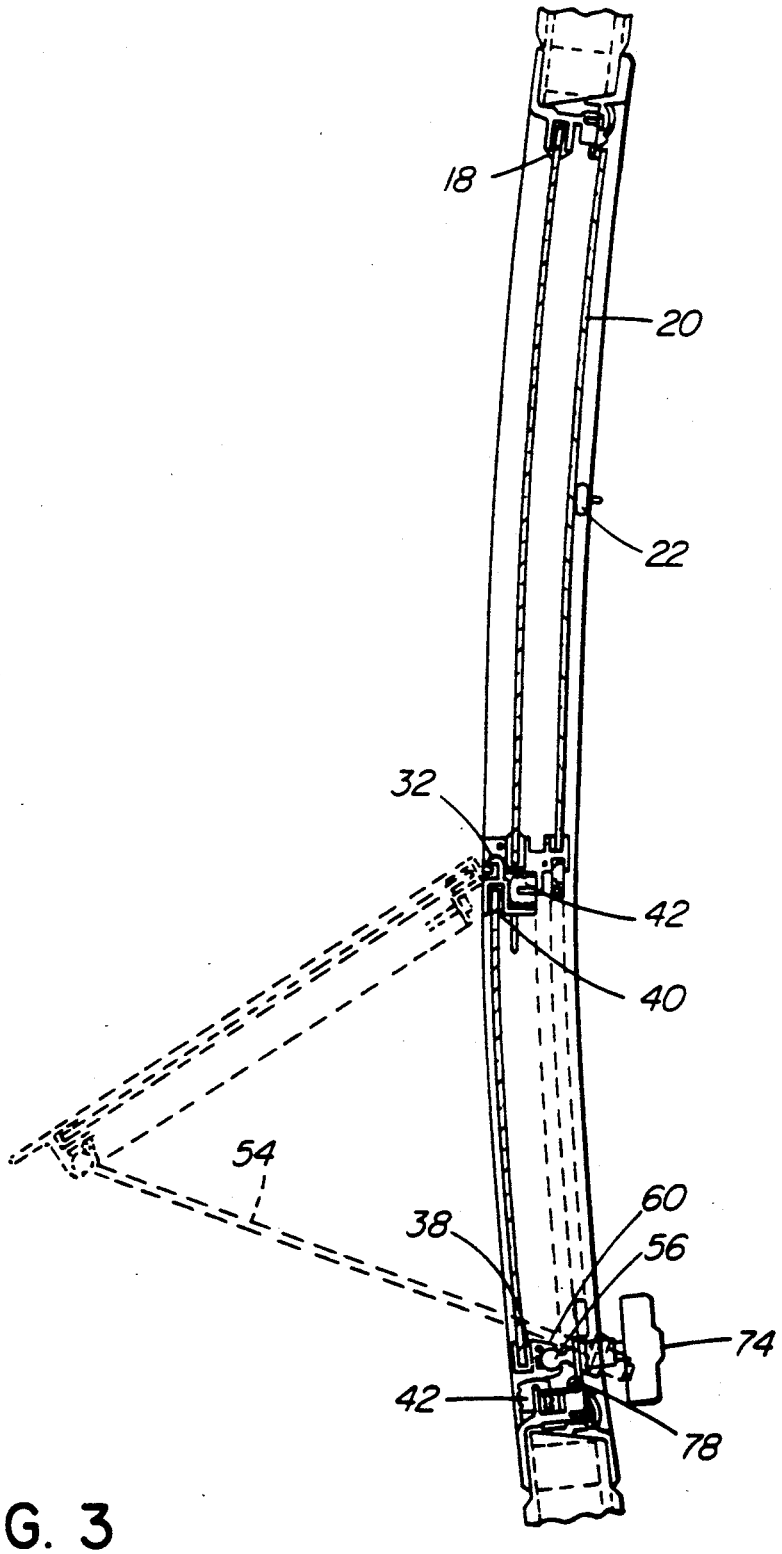
FIG. 3 is a vertical cross-section view taken through the awning.

Hence, by virtue of the structure described above, rotation of the operating knob 74 effects pivotal movement of the arms 54 relative to the housing 66 of the operating mechanism. This arm movement, in turn, causes the balls 56 on the distal ends of arms 54 to move either toward or away from one another within the guide track 60. This relative movement between the balls 56 and guide track 60 is, in turn, translated into pivotal motion of the awning window 30 between the open and closed positions about the previously described hinge 32. The degree of pivotal motion thus provided can be quite substantial and in the embodiment shown the awning window is capable of movement through an arc of about 60° between the closed and open positions as best illustrated in FIG. 3. The advantages of the configuration described will be readily apparent to those skilled in the art from the foregoing description.

While a preferred embodiment of the invention has been described and illustrated by way of example only, those skilled in the art will realize that numerous modifications and variations are possible within the scope of the invention. For definitions of the invention reference is to be had to the claims appended hereto.

What is claimed is:

1. A window assembly, comprising a pivotally mounted window having a movable window frame co-operable with a fixed window frame, a window operator including an operating mechanism mounted to said fixed window frame, an elongated guide track extending along a portion of the movable window frame, and wherein the operating mechanism includes rigid elongated arm means and means for effecting pivotal motion of said arm means relative to the fixed window frame, the arm means having motion transmitting means mounted to distal free end portions of same, said motion transmitting means being engaged with said elongated guide track and adapted to move therealong as the arm means are pivoted thereby to pivot the movable window frame between open and closed positions and wherein said arm means comprises a pair of free-ended rigid arms adapted to pivot towards and away from one another in a first plane of movement to pivot the movable window frame between the open and closed positions respectively, said motion transmitting means comprising a pair of balls each being firmly secured to the distal end of a respective one of said arms, and said guide track having a groove shaped to complement the shape and size of the balls and said groove securing the balls directly therein while permitting free movement of the balls therealong, said operating mechanism including hinge means mounting said operating mechanism to the fixed window frame to allow said arms and the first plane of movement defined thereby to pivot about an axis defined by said hinge means so that said arms also pivot in a further plane at right angles to the first plane with said balls on the distal ends of said arms moving both longitudinally of and rotating relative to said guide track during movement of the movable window frame between the open and closed positions.

2. The window assembly of claim 1 wherein each said ball is secured directly to the distal end of the arm associated therewith, and said guide track including an entrance slot leading into said groove sufficiently wide as to permit a predetermined amount of angular motion of the arm relative thereto and hence of the movable window frame between the open and the closed positions.

3. The window assembly of claim 1 wherein the operating mechanism includes a housing, proximal end portions of said arms being pivotally mounted in said housing, gear means for effecting simultaneous pivotal motion of the arms and manually operable means coupled to said gear means to activate the latter and effect the motion of the arms.

4. The window assembly of claim 1 in the form of an awning window wherein said movable window frame is pivotally mounted adjacent its upper extremity to the fixed window frame, said guide track extending lengthwise of and integrally formed with that portion of the movable window frame which is at a lower extremity thereof, and said operating mechanism being secured to a lower portion of the fixed window frame in a generally central location therealong.

5. The window assembly of claim 4 wherein the fixed window frame forms part of a fixed upper window with a horizontal intermediate frame member at a bottom edge of the fixed upper window, hinge means cooperating with the intermediate frame member and an upper edge of said movable window frame to provide for the pivoting motion of the window frame between the open and the closed positions.

6. The window assembly of claim 5 wherein the upper edge of the movable window frame is straight, the lower portion of the last mentioned frame having curved corners and the elongated guide track being integrally formed with said lower portion of such frame.

7. The window assembly of claim 1 wherein said guide track has a notch located centrally thereof to permit exit or entry of said balls, and a removable stop disposed in said notch to prevent unwanted release or removal of the balls during normal operation of the window assembly.

* * * * *

UNITED STATES PATENT AND TRADEMARK OFFICE

CERTIFICATE OF CORRECTION

PATENT NO. : 5,103,590

DATED : April 14, 1992

INVENTOR(S) : Jacobus N. Hanemaayer

It is certified that error appears in the above-identified patent and that said Letters Patent is hereby corrected as shown below:

On the title page, please add:

Foreign Application Priority Data

Jan. 24, 1990 Canada 2008464

Signed and Sealed this

Sixth Day of July, 1993

*Attest:*

Michael K. Kirk

MICHAEL K. KIRK

*Attesting Officer*

*Acting Commissioner of Patents and Trademarks*